US006331136B1

(12) United States Patent
Bass et al.

(10) Patent No.: US 6,331,136 B1
(45) Date of Patent: Dec. 18, 2001

(54) CMP PAD CONDITIONER ARRANGEMENT AND METHOD THEREFOR

(75) Inventors: Victor J. Bass; Landon Vines, both of San Antonio, TX (US)

(73) Assignee: Koninklijke Philips Electronics N.V. (KPENV), Eindhoven (NL)

( * ) Notice: Subject to any disclaimer, the term of this patent is extended or adjusted under 35 U.S.C. 154(b) by 0 days.

(21) Appl. No.: 09/490,466

(22) Filed: Jan. 25, 2000

(51) Int. Cl.[7] ..... B24C 5/00

(52) U.S. Cl. ..... 451/56; 451/41; 451/66; 451/443

(58) Field of Search ..... 451/51, 41, 56, 451/42, 66, 109, 111, 443, 444; 15/29, 180, 21.1

(56) References Cited

U.S. PATENT DOCUMENTS 5,456,627 * 10/1995 Jackson et al. ..... 451/56 X
5,531,635 * 7/1996 Mogi et al. ..... 451/443 X
5,547,417 * 8/1996 Breivogel et al. ..... 451/56
5,611,943 * 3/1997 Cadien et al. ..... 451/444 X
5,616,069 * 4/1997 Walker et al. ..... 451/444 X
5,868,608 * 2/1999 Allman et al. ..... 451/443 X
5,885,147 * 3/1999 Kreager et al. ..... 451/443
5,916,010 * 6/1999 Varian et al. ..... 451/443 X
6,179,693 * 1/2001 Beardsley et al. ..... 451/56

OTHER PUBLICATIONS

U.S. Pat. application No. 09/283,049, "CMP Pad Conditioner Arrangement and Method Therefor," Filing Date Apr. 1, 1999.

U.S. Pat. application No. 09/283,716, "Dual CMP Pad Conditioner," Filing Date Apr. 1, 1999.

* cited by examiner

*Primary Examiner*—Joseph J. Hail, III
*Assistant Examiner*—Anthony Ojini

(57) ABSTRACT

The present invention is directed to a method and apparatus for cleaning and enhancing CMP polishing pads. According to an example embodiment of the present invention, a fluid source supplies cleaning elements to a CMP pad conditioner arrangement at pressure of about 20 PSI. A dispensing arrangement is coupled to the fluid source and is adapted to disperse the cleaning elements and to dispense the elements onto a CMP pad. The high-pressure cleaning of the CMP pad improves the ability to clean the pad over existing methods, reduces processing defects, increases the pad life, and improves the uniformity of the polish rate.

28 Claims, 2 Drawing Sheets

CM P PAD CONDITIONER ARRANGEMENT AND METHOD THEREFOR

RELATED APPLICATIONS

This application is related to U.S. patent application Ser. No. 09/283,049, filed on Apr. 1, 1999 and entitled "CMP Pad Conditioner Arrangement and Method Therefor," and to U.S. patent application Ser. No. 09/283,716, filed on Apr. 1, 1999 and entitled "Dual CMP Pad Conditioner," each being incorporated herein by reference.

FIELD OF THE INVENTION

The present invention relates generally to semiconductor devices and their fabrication and, more particularly, to semiconductor devices and tools for their manufacture involving chemical-mechanical polishing (CMP).

BACKGROUND OF THE INVENTION

The electronics industry continues to rely upon advances in semiconductor manufacturing technology to realize higher-functioning devices while improving reliability and cost. For many applications, the manufacture of such devices is complex, and maintaining cost-effective manufacturing processes while concurrently maintaining or improving product quality is difficult to accomplish. As the requirements for device performance and cost become more demanding, realizing a successful manufacturing process becomes more difficult.

A byproduct of the increased complexity of semiconductor devices includes uneven device surfaces, which become more prominent as additional levels are added to multilevel-interconnection schemes and circuit features are scaled to submicron dimensions. Typically, each level within the device is patterned, resulting in a surface with varied "step-heights" where metal forming the pattern remains on the surface.

Planarization is a term describing the surface geometry of a semiconductor device. Complete planarization occurs when the surface of the dielectric is flat, as in a plane. No planarization occurs when the surface of the dielectric directly models the "step-height" surface of the metal pattern in the layer underneath. The degree of planarization refers to the degree to which the varied surface geometry can be "planarized," or smoothed out into a planar surface. Varied surface geometry is often undesirable. Therefore, as additional layers are formed within devices, the required degree of planarization increases.

A commonly used planarization process in semiconductor device manufacturing is chemical-mechanical polishing, or CMP. CMP is useful in the planarization of silicon wafers and of VLSI circuits between different manufacturing processes. CMP is a popular planarization method, due in part to its usefulness in the global planarization of semiconductor devices. Traditional planarization processes are restricted to effecting local planarity or topographical variation on a small scale, whereas CMP is often useful on a global scale greater than ten microns.

In one application, a CMP process involves securing a semiconductor wafer to a wafer holder with the wafer located face-down on a polish pad. Both the polish pad and the wafer holder rotate. A slurry, typically a colloidal silica that is a suspension of $SiO_2$ particles, is applied to the process. The particle size typically varies from 100 angstroms to 3 microns. The slurry is generally applied using a wand feeding to the wafer holder and pad. The rate of removal of material from the wafer is a combination of chemical and mechanical rates. The mechanical removal rate is roughly proportional to the pressure and the relative velocity of the wafer. The chemical removal rate is a function of the size of the slurry particles and the solution pH, wherein the maximum removal rate is generally obtained using a slurry having a pH of about 11.5.

In addition to the use of slurry in the CMP process, other conditioning elements are sometimes used for conditioning the polish pad. The conditioners aid in the CMP polishing process and contribute to the longevity of the pad. Another need in the CMP process is for adequately and efficiently cleaning the pad and the wafer itself. In clean room environments, it is important to maintain a CMP process that produces as few contaminants as possible. Since the slurry particle size ranges in the sub-3 micron range, clean-up is difficult and thus of high importance. In addition, it is helpful to prevent the byproduct resulting from the polishing of each wafer from accumulating on the pad and reaching additional wafers.

Traditional methods for cleaning and conditioning the pad are sometimes inadequate for removing the residual CMP reaction by-products and particles embedded in the pad. In addition, inadequately cleaned pads can cause the subsequent distribution of slurry for further processing to be non-uniform. The non-uniform distribution of slurry hinders the polishing process. These disadvantages may result in, for example, long arc style scratches, shallow micro-scratches, inter-die thickness variation, and residual slurry particles. These disadvantages ultimately result in a significant yield lost and in reliability problems due in part to possible metal stringers in the shallow scratch area and surrounding residual slurry particles. In addition, the pads used in the CMP process must be changed more often due to inadequate cleaning, resulting in increased manufacturing costs associated with the pads.

SUMMARY OF THE INVENTION

The present invention is directed to a method and apparatus for improving the CMP process, the improvements including but not limited to enhanced pad cleaning, and conditioning, better uniformity of the polish rate, longer pad life, improved wafer quality and reliability, and faster production. In addressing these problems in connection with the present invention, it has been unexpectedly discovered that the above improvements are advantageously realized using a fluid source adapted to supply cleaning elements at a pressure of at least about 20 PSI in a dispensing arrangement such as described hereinbelow. The present invention is exemplified in a number of implementations and applications, some of which are summarized below.

According, to an example embodiment of the present invention, a CMP pad conditioner arrangement includes a fluid source adapted to supply cleaning elements at a pressure of at least about 20 PSI. The fluid source is coupled to a dispensing arrangement adapted to disperse the elements and to dispense the cleaning elements onto a CMP pad.

According to another example embodiment, the CMP pad conditioner arrangement described in the preceding paragraph is used to clean a CMP pad. Cleaning solution, such as water, is supplied to the dispensing arrangement at a pressure of at least about 20 PSI. The cleaning solution is passed onto a CMP pad by the dispenser and the high-pressure solution is used to clean the pad.

The above summary of the present invention is not intended to describe each illustrated embodiment or every implementation of the present invention. The figures and detailed description which follow more particularly exemplify these embodiments.

BRIEF DESCRIPTION OF THE DRAWINGS

The invention may be more completely understood in consideration of the following detailed description in connection with the accompanying drawings, in which.

Figure 1B:
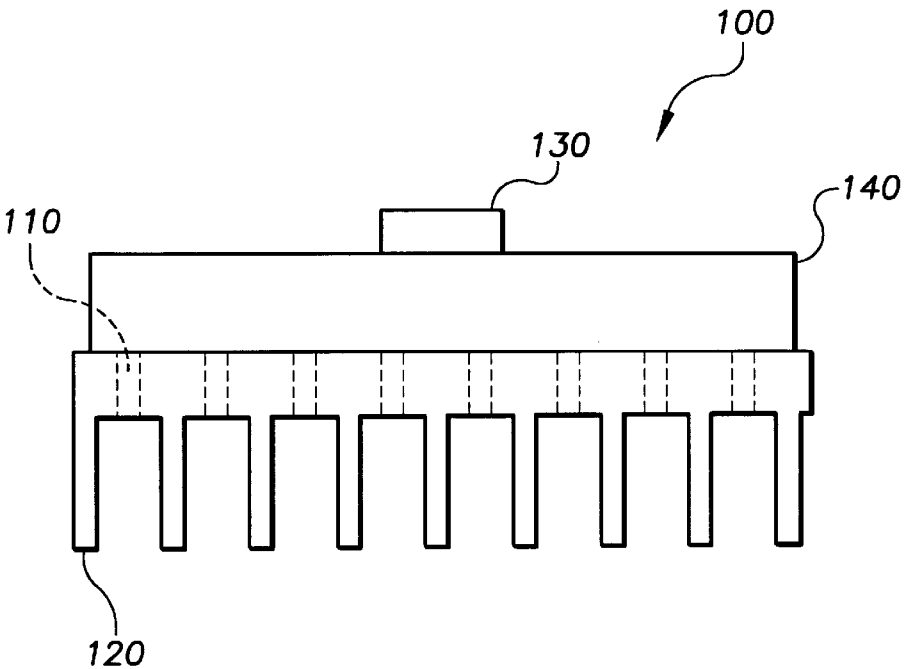
FIG. 1 shows top and side views of a first CMP pad conditioner arrangement, according to an example embodiment of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION

The present invention is directed to an arrangement and method for cleaning a CMP polishing pad. According to an example embodiment of the present invention, a CMP pad conditioner includes a fluid source adapted to supply cleaning elements at a pressure of at least about 20 PSI. A dispensing arrangement is coupled to the fluid source and is adapted to dispense the cleaning elements onto a CMP pad. It has been discovered that the above fluid source and dispensing arrangement facilitate cleaning to a depth into a CMP pad that sufficiently addresses current problems associated with CMP pad conditioners including those discussed hereinabove in the Background of the Invention.

In one particular example embodiment, the dispensing arrangement includes a distribution surface adapted to receive and disperse the cleaning elements, such as liquid or a liquid solution, at high-pressure and high-volume. The dispensing arrangement further includes a dispenser having a plurality of ports coupled to the distribution surface and adapted receive the cleaning elements, and to pass the cleaning elements onto a CMP pad. In one particular implementation, the cleaning elements are received at a pressure of at least about 30 PSI for a more difficult and thorough cleaning application. In addition, the flow rate of the cleaning elements can vary with the size of the pad conditioner and the number of holes, and typically is above about 1.5 GPM. In this manner, the high-pressure, high-volume cleaning elements improve the cleaning of the pad by drawing particles embedded in the pad up out of the pad and removing them. This cleaning of the pad improves the pad life, reduces the number of defects, and improves the uniformity of the polish rate.

Figure 1A:
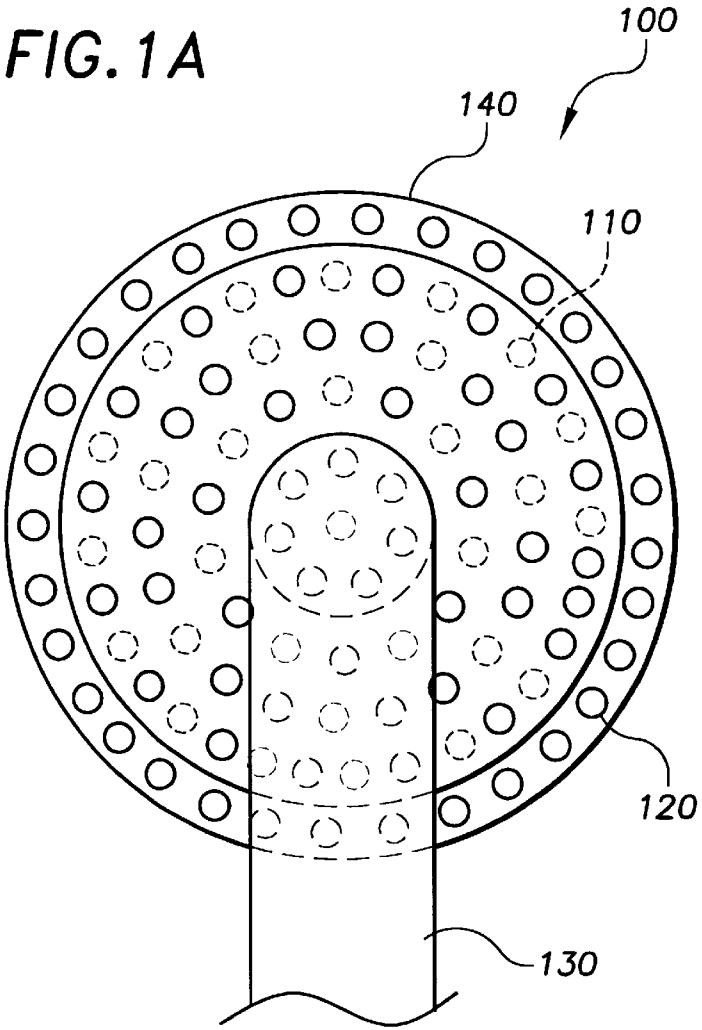

FIG. 1 shows top and side views of a CMP pad conditioner arrangement 100 for use in a CMP process, according to another example embodiment of the present invention. A supply 130 is configured and arranged to supply cleaning elements to a pad conditioner head 140. Pad conditioner head 140 includes holes 110 for receiving cleaning elements at a pressure of at least about 30 PSI and a flow rate of at least about 1.5 GPM, and for dispensing the cleaning elements to the surface to be conditioned. Supply 130 is further adapted to deliver fluid at the high pressure and flow rates described. In one particular implementation, the holes are between about ⅛ inch and about ¼ inch in diameter. In another particular implementation, the holes are located at a density of between about 9–36 holes per square inch. Brushes 120 are coupled to the pad conditioner head 140. The brushes may, for instance, comprise chemically resistant material, such as plastic or Teflon. The use of chemically resistant brushes is particularly advantageous in applications where the cleaning elements include chemicals that are reactive with non-chemically resistant brush material. The brushes may also include material such as metal, diamond, and nickel, and may include chemically inert material. The use of chemically inert material for the brushes is particularly useful in connection with the use of cleaning solutions having an acidic or basic nature.

According to another example embodiment, the CMP pad conditioning arrangement shown in FIG. 1 is used to clean and condition a CMP pad. Cleaning elements are delivered to the pad conditioner head 140 by way of supply 130. The cleaning elements may include, for example, chemicals ranging in pH from highly basic to highly acidic, or solvents such as de-ionized (DI) water. The cleaning elements are dispersed in the head 140, and dispensed through holes 110. Brushes 120 are coupled to the pad conditioner head 140, and are caused to contact a rotating CMP pad. In one particular example embodiment, the CMP pad is rotated at a rotational speed sufficiently greater than the speed used for the CMP polishing process such that the cleaning elements and the residual polishing elements are centrifugally removed from the pad. It has been discovered that, in combination with the high-pressure, high-flow cleaning supply, a rotational speed of about 50% greater than the polishing speed is useful, for example, for throwing the used slurry off of the CMP pad. The cleaning elements are dispersed onto the CMP pad, and the CMP pad is cleaned and conditioned. Cleaning and conditioning the CMP pad may, for instance, also include rotating the pad conditioner head 140, such as rotating about its center using a motor/axle arrangement (not shown) coupled to the housing for the supply 130. For further examples and explanation of pad conditioners adaptable for use in accordance with the present invention, reference may be made to U.S. Pat. No. 6,302,771, issued on Oct. 16, 2001 (Docket No. VLSI.231PA).

In another example embodiment of the present invention, the pad conditioner arrangement shown in FIG. 1 is used in conjunction with a second pad conditioner arrangement adapted to dispense slurry and condition the pad. The pad cleaning arrangement of FIG. 1 is used to clean the pad of polishing residuals and of the slurry dispensed by the second pad. In more particular example embodiment of the present invention, a plurality of CMP pad conditioners are used for supplying slurry, and a plurality of CMP pad conditioners such as shown in FIG. 1 are used to clean the pad, facilitating the polishing of a plurality of wafers at the same time.

Several arrangements of the CMP pad shown in FIG. 1, for example, can be used for cleaning the plurality of wafers at the same time. In one arrangement, two wafers are polished using a CMP polishing arrangement having two slurry dispensing pad conditioner arrangements and two cleaning pad conditioner arrangements. A first slurry dispensing pad conditioner dispenses slurry and conditions the pad. The pad is rotated, the slurry is used to polish a first wafer, and is cleaned by a first CMP pad conditioner arrangement, such as shown in FIG. 1, thereby preventing slurry and polishing residuals from reaching the second wafer arrangement. A second slurry dispensing pad conditioner dispenses slurry and conditions the pad. The pad is rotated, the slurry is used to polish the second wafer, and the pad is cleaned by a second CMP pad conditioner arrangement, such as shown in FIG. 1, thereby preventing slurry and polishing residuals from reaching the first wafer as the pad rotates. For more information and description regarding the use of dual CMP pad conditioners, reference may be made to U.S. patent application Ser. No. 09/283,716, filed on Apr. 1, 1999 and entitled "Dual CMP Pad Conditioner".

According to another example embodiment of the present invention, a semiconductor wafer is manufactured using the CMP pad conditioner and pad described in the above paragraph. After the pad is cleaned and conditioned, a slurry is introduced to the pad and the pad is caused to rotate. The semiconductor wafer is held face-down, brought into contact with the slurry and the pad, and polished.

Figure 2B:
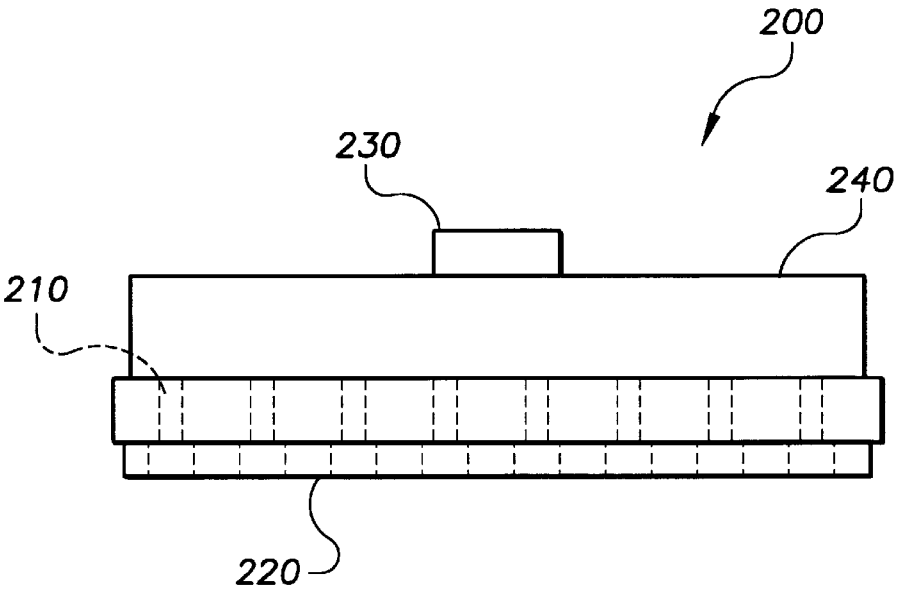
FIG. 2 shows top and side views of a second CMP pad conditioner arrangement, according to another example embodiment of the present invention.
Figure 2A:
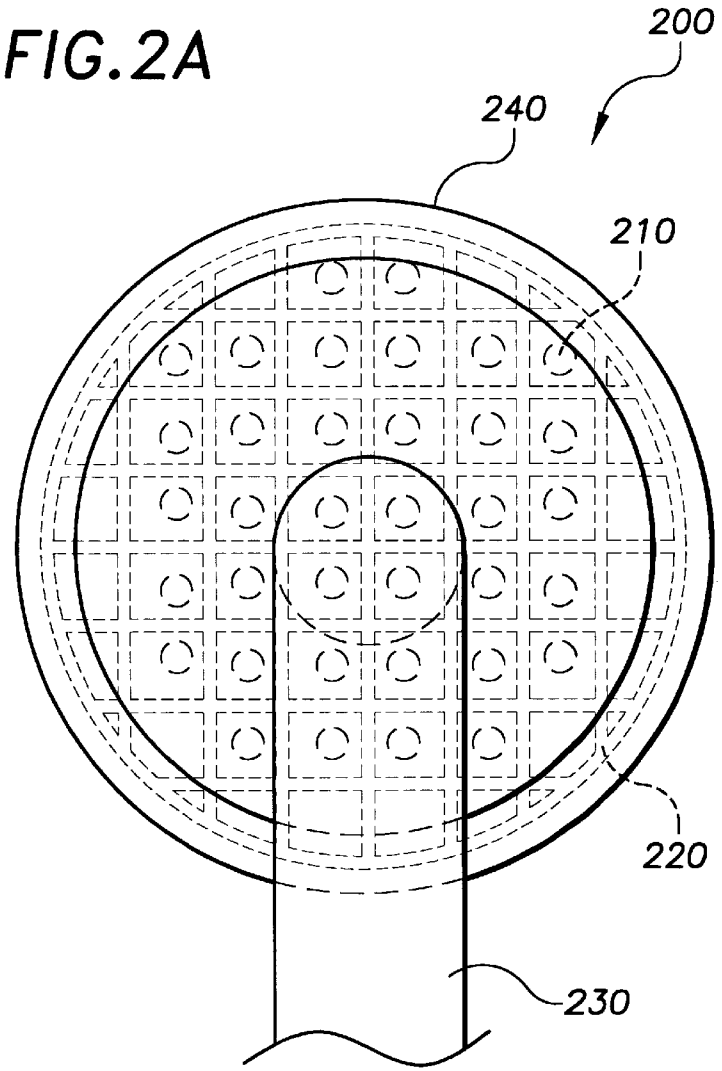

FIG. 2 shows top and side views of a CMP pad conditioner arrangement 200 for use in a CMP process, according to another example embodiment of the present invention. The CMP pad conditioner arrangement 200 is similar to the CMP pad arrangement 100 shown in FIG. 1, except having a grid arrangement 220 in place of the brushes 120. Grid arrangement 220 is coupled to the pad conditioner head 240 and may include, for instance, material such as metal, plastic, Teflon, diamond, or CVD diamond coated with Nickel.

According to another yet example embodiment of the present invention, the CMP pad conditioning arrangement 200 is used to clean and condition a CMP pad. Referring again to FIG. 2, supply 230 is coupled to pad conditioner head 240. Cleaning elements are delivered to the pad conditioner head 240 by way of supply 230. The cleaning elements are dispersed in the head 240, and dispensed through holes 210 at a pressure of at least about 30 PSI and a flow rate of at least about 1.5 GPM. Grid arrangement 220 is coupled to pad conditioner head 240, and is caused to contact a CMP pad. The cleaning elements are dispersed onto the CMP pad, and the CMP pad is cleaned and conditioned. Cleaning and conditioning the CMP pad may, for instance, also include rotating the pad conditioner head 240, in a manner such as rotating about its center using a motor/axle arrangement (not shown) coupled to the housing for the supply 230.

Skilled artisans will recognize that the above-discussed example embodiments may be implemented by modifying commercially-available equipment. Examples of such equipment include MIRRA and 6DS SP, respectively manufactured by Applied Material and Strausbough.

While the present invention has been described with reference to several particular example embodiments, those skilled in the art will recognize that many changes may be made thereto. For example, many features of the above embodiments are combinable in a single conditioner arrangement and/or conditioning process. Such changes do not depart from the spirit and scope of the present invention, which is set forth in the following claims.

What is claimed is:

1. A CMP pad conditioner arrangement, comprising:

a fluid source adapted to supply cleaning elements at a pressure of at least about 20 PSI;

a dispensing arrangement coupled to the fluid source and adapted to disperse the cleaning elements and to dispense the cleaning elements onto a CMP pad; and means, coupled to dispensing arrangement, for scrubbing while the dispensing arrangement disperses and dispenses the cleaning elements.

2. A CMP pad conditioner arrangement, according to claim 1, wherein the dispensing arrangement comprises:

a distribution surface coupled to the fluid source and adapted to disperse the cleaning elements; and a plurality of ports coupled to the distribution surface and adapted to receive the cleaning elements at the pressure of at least about 20 PSI and to dispense the cleaning elements onto a CMP pad.

3. A CMP pad conditioner arrangement, according to claim 2, wherein the ports have a diameter of between about ⅛ inch and ¼ inch.

4. A CMP pad conditioner arrangement, according to claim 2, wherein the ports are formed having a density of about 9–36 ports per square inch.

5. A CMP pad conditioner arrangement, according to claim 1, wherein the means for scrubbing includes a brush arrangement.

6. A CMP pad conditioner arrangement, according to claim 1, wherein the means for scrubbing includes a grid arrangement.

7. A CMP pad conditioner arrangement, according to claim 1, wherein the means for scrubbing includes material comprising at least one of: Teflon, plastic, metal, chemically inert material, diamond, and nickel.

8. A CMP pad conditioner arrangement, according to claim 1, wherein the scrubbing means is a material selected from the group of: teflon, plastic, metal, chemically inert material, diamond, and nickel.

9. A CMP pad conditioner arrangement, according to claim 1, wherein the scrubbing means includes means for securing scrubbing material.

10. A CMP pad conditioner arrangement, according to claim 1, further comprising a rotation device configured to rotate the dispensing arrangement.

11. A CMP pad conditioner arrangement, according to claim 1, wherein the dispensing arrangement is adapted to receive cleaning elements at a flow rate of at least about 1.5 gallons per minute (GPM) and further comprises at least one high-flow, high pressure inlet port adapted to receive cleaning elements from the fluid source at a flow rate of at least about 1.5 GPM and at a pressure of at least about 20 PSI.

12. A CMP pad conditioner arrangement, according to claim 1, wherein the dispensing arrangement is adapted to receive cleaning elements at a pressure of at least about 30 PSI.

13. A CMP pad condition arrangement, comprising:

a fluid source adapted to supply cleaning elements;

a dispensing arrangement coupled to the fluid source and adapted to disperse the cleaning elements and to dispense the cleaning elements onto a CMP pad; and a rotation device adapted to rotate the CMP pad at a first polishing rotational speed and at a second cleaning rotational speed, wherein the second cleaning rotational speed is high enough to centrifugally eject the cleaning elements and residue from the pad.

14. A method for conditioning a CMP pad, the method comprising:

receiving cleaning elements at a CMP pad conditioner at a fluid pressure of at least about 20 PSI; and dispersing the cleaning elements at the CMP pad conditioner and passing them onto a CMP pad while the pad is being scrubbed.

15. A method for conditioning a CMP pad, according to claim 14, wherein receiving cleaning elements includes receiving cleaning elements via at least one inlet port adapted to withstand cleaning element supply having a fluid pressure of at least about 20 PSI.

16. A method for conditioning a CMP pad, according to claim 14, wherein dispersing the cleaning elements at the CMP pad conditioner includes dispersing via a distribution surface.

17. A method for conditioning a CMP pad, according to claim 14, wherein passing the cleaning elements onto the CMP pad includes passing the cleaning elements via a plurality of outlet ports.

18. A method for conditioning a CMP pad, according to claim 14, wherein the CMP pad conditioner includes at least one of: a grid; a brush; and a disk.

19. A method for conditioning a CMP pad, according to claim 14, further comprising using the pad conditioner to remove deposits on the pad.

20. A method for conditioning a CMP pad, according to claim 14, further comprising using the pad conditioner to rough the pad.

21. A method for conditioning a CMP pad, according to claim 14, wherein the cleaning elements comprise at least one of: water, a chemical having a pH less than 7, and a chemical having a pH greater than 7.

22. A method for conditioning a CMP pad, according to claim 14, further comprising rotating the CMP pad conditioner.

23. A method for conditioning a CMP pad, according to claim 14, wherein the fluid is supplied at a flow rate of at least about 1.5 GPM.

24. A method for conditioning a CMP pad, according to claim 14, wherein the fluid pressure is at least about 30 PSI.

25. A method for conditioning a CMP pad, comprising:

receiving cleaning elements at a CMP pad conditioner;

dispersing the cleaning elements at the CMP pad conditioner and passing them onto a CMP pad; and rotating the CMP pad at a second rotational speed greater than a first rotational speed used during CMP polishing processes, the second rotational speed being high enough to centrifugally remove cleaning elements and residual polishing elements from the pad.

26. A CMP pad conditioner arrangement, comprising:

means for receiving cleaning elements at a pressure greater than about 30 PSI;

means for dispersing the cleaning elements and for dispensing the cleaning elements onto a CMP pad; and means for scrubbing coupled to dispersing means.

27. A CMP pad conditioner arrangement, according to claim 26, further comprising rotation means for rotating the means for dispensing the cleaning elements onto a CMP pad.

28. A method for manufacturing a semiconductor wafer, the method comprising:

providing a conditioner apparatus having at least one inlet port adapted to receive cleaning elements, a distribution surface coupled to the inlet port, a scrubbing arrangement adjacent the distribution surface and a plurality of outlet ports adapted to pass cleaning elements at a flow rate of at least about 1.5 GPM and at a pressure of at least about 30 PSI onto a CMP pad;

receiving cleaning elements via an inlet port;

dispersing the cleaning elements via the distribution surface, dispensing the cleaning elements onto the CMP pad via the multitude of outlet ports while scrubbing the pad;

introducing a slurry to the cleaned pad; and using the slurry and the cleaned, pad polishing the semiconductor wafer.

* * * * *